US007403115B2

(12) United States Patent
Yuzik

(10) Patent No.: US 7,403,115 B2
(45) Date of Patent: Jul. 22, 2008

(54) SYSTEM AND METHOD FOR SURVEILLANCE OF SUSPECTS OF AUTOMATED BANKING MACHINE FRAUD

(75) Inventor: Rodney J. Yuzik, Burlington (CA)

(73) Assignee: International Business Machines Corporation, Armonk, NY (US)

( * ) Notice: Subject to any disclaimer, the term of this patent is extended or adjusted under 35 U.S.C. 154(b) by 385 days.

(21) Appl. No.: 11/231,637

(22) Filed: Sep. 21, 2005

(65) Prior Publication Data

US 2007/0063838 A1 Mar. 22, 2007

(51) Int. Cl.
*G08B 21/00* (2006.01)

(52) U.S. Cl. ..... 340/540; 348/150

(58) Field of Classification Search ..... 340/540, 340/539.25, 5.41, 5.9; 235/379, 381; 348/135, 348/143, 150, 154–155; 725/9
See application file for complete search history.

(56) References Cited

U.S. PATENT DOCUMENTS

| | | | | |
|---|---|---|---|---|
| 5,996,023 | A * | 11/1999 | Winter et al. | 709/253 |
| 6,230,928 | B1 | 5/2001 | Hanna et al. | 221/13 |
| 6,317,152 | B1 * | 11/2001 | Hobson et al. | 348/150 |
| 6,400,276 | B1 | 6/2002 | Clark | 340/640 |
| 6,583,813 | B1 * | 6/2003 | Enright et al. | 348/150 |
| 6,761,308 | B1 | 7/2004 | Hanna et al. | 235/379 |
| 6,839,083 | B2 * | 1/2005 | Hamamoto et al. | 348/150 |
| 7,195,172 | B1 * | 3/2007 | Scarafile et al. | 235/486 |
| 2004/0141058 | A1 * | 7/2004 | Ramachandran et al. | 348/150 |
| 2004/0148256 | A1 | 7/2004 | Bramnick et al. | 705/40 |
| 2005/0073584 | A1 * | 4/2005 | Enright et al. | 348/150 |
| 2005/0091524 | A1 | 4/2005 | Abe et al. | 713/200 |
| 2006/0118624 | A1 * | 6/2006 | Kelso et al. | 235/439 |
| 2006/0169764 | A1 * | 8/2006 | Ross et al. | 235/379 |
| 2007/0040023 | A1 * | 2/2007 | Ruggirello et al. | 235/381 |

OTHER PUBLICATIONS

INSPEC: "Intelligent Video Surveillance Systems", AN-7829028, R. Dunn, 2003.
"Face Recognition: A Literature Survey", W. Zhao et al., 2003.
"Usability and Biometric Verification at the ATM Interface", L. Coventry, et al., 2003.
"A Pin-Entry Method Resilient Against Shoulder Surfing", V. Roth, et al., 2004.

* cited by examiner

*Primary Examiner*—John A Tweel, Jr.
(74) *Attorney, Agent, or Firm*—George R. McGuire; Bond Schoeneck & King, PLLC

(57) ABSTRACT

There is disclosed a method and system for surveillance of a suspect of automated banking machine (ABM) fraud. In an embodiment, there is a detector for detecting the presence of a foreign device targeting an ABM, the detector being configured to generate an alarm notification upon such detection. A plurality of surveillance cameras may be positioned to monitor an ABM and its surroundings. A video recording device is operatively connected to the detector and configured to archive the video signals recorded from the plurality of surveillance cameras upon receipt of the alarm notification. The detector may be configured to generate the alarm notification after a predetermined delay, and at least one of the archived recorded video signals should have a recorded length exceeding the predetermined delay for alarm notification in order to permit review of suspicious activity that generated the alarm notification.

20 Claims, 6 Drawing Sheets

SYSTEM AND METHOD FOR SURVEILLANCE OF SUSPECTS OF AUTOMATED BANKING MACHINE FRAUD

BACKGROUND OF THE INVENTION

The present invention relates to a system and method for surveillance of suspects of automated banking machine (ABM) fraud.

ABMs have become ubiquitous and are now found in many locations including banks, shopping malls, casinos, airports, bus and train terminals, gas stations, grocery stores, convenience stores, retail outlets, etc. The widespread availability and use of ABMs has unfortunately also prompted the development of ABM targeted technologies designed for fraudulent purposes. One example is an unauthorized magnetic stripe reader that may be surreptitiously placed by a suspect on or near an ABM to "skim" data from victims' bank cards. To skim the victims' bank cards, the unauthorized magnetic stripe reader may, for example, be integrated with the magnetic stripe reader on the ABM, or camouflaged in various locations on the ABM, or placed at a secured entrance permitting access to the ABM.

The bank card information illicitly skimmed in this manner allows a suspect to create a copy of a victim's bank card for fraudulent purposes. To provide additional protection, most bank cards have an associated personal identification number (PIN). Thus, in addition to obtaining a copy of the information stored on the magnetic stripe of the bank card, the suspect also needs to obtain the PIN. Suspects may attempt to do this, for example, by placing a spy camera on or near the ABM to point to the keypad on the ABM as the victim is entering the PIN. Alternatively, the suspect may place a wiretap or a keypad sensor on or underneath the actual ABM keypad in order to capture or sense the keystrokes as the victim enters the PIN.

With both the bank card information and the PIN, the suspect has sufficient information to duplicate the victim's bank card, and if undetected, to fraudulently withdraw funds from the victim's bank account(s). These fraudulent activities have led to security and privacy concerns, and to tangible and significant monetary losses for the victims and/or the financial institutions providing the ABMs.

What is needed is a more effective system and method for surveillance of suspects of ABM fraud.

OBJECTS AND SUMMARY OF THE INVENTION

The present invention relates to a system and method for more timely surveillance of suspects of ABM fraud.

In an aspect of the invention, there is provided a system for surveillance of a suspect of automated banking machine (ABM) fraud, comprising: at least one detector for detecting the presence of a foreign device targeting an ABM, the at least one detector being configured to generate an alarm notification upon such detection; at least one surveillance camera, each surveillance camera targeting at least one of the ABM and its surroundings; a video recording device for recording at least one video signal from at least one surveillance camera, the video recording device being configured to archive the at least one video signal recorded from the at least one surveillance camera upon receipt of the alarm notification.

In an embodiment, the at least one detector is configured to generate the alarm notification after a predetermined delay, and at least one of the archived recorded video signals has a recording length exceeding the predetermined delay for alarm notification.

In another embodiment, the at least one video signal from the at least one surveillance camera is converted if necessary to a digital signal, and the video recording device is configured to record the video signal from each surveillance camera in corresponding video files.

In another embodiment, the at least one detector is configured to generate the alarm notification after a predetermined delay, and each of the corresponding video files is preset to have a maximum recording length exceeding the predetermined delay for alarm notification.

In yet another embodiment, the corresponding video files for each surveillance camera are rotated in succession, such that after an initial start-up period at least one of the corresponding video files has a recording length exceeding the predetermined delay for alarm notification.

In still another embodiment, the system further includes a remote data processing system operatively connected to the ABM and to the video recording device, the remote data processing system being configured to retrieve the video files recorded on the video recording device.

In another embodiment, the remote data processing system is operatively connected to the ABM and to the video recording device over a communications network.

In another embodiment, the remote data processing system is configurable to disable the ABM upon confirmation of suspicious activity recorded in the video files.

In still another embodiment, the at least one detector is one of an electromagnetic field sensing device, an image comparison device, and a radiofrequency sensing device.

In another aspect of the invention, there is provided a method of surveillance of a suspect of ABM fraud, comprising: recording at least one video signal from at least one surveillance camera, each surveillance camera targeting at least one of the ABM and its surroundings; detecting the presence of a foreign device targeting the ABM and, upon such detection, generating an alarm notification; upon receipt of the alarm notification, archiving the at least one video signal recorded from the at least one surveillance camera.

In an embodiment, the method further comprises providing a predetermined delay for the alarm notification, and setting a maximum recording length for the at least one recorded video signal to exceed the predetermined delay for alarm notification.

In another embodiment, the method further comprises converting if necessary the at least one video signal from the at least one surveillance camera to a digital signal, and recording the video signal from each surveillance camera in corresponding video files.

In another embodiment, the method further comprises providing a predetermined delay for the alarm notification, and setting a maximum recording length for each of the corresponding video files exceeding the predetermined delay for alarm notification.

In yet another embodiment, the method further comprises rotating in succession the corresponding video files for each surveillance camera, such that after an initial start-up period at least one of the corresponding video files has a recorded length exceeding the predetermined delay for alarm notification.

In still another embodiment, the method further comprises providing a remote data processing system operatively connected to the ABM and to the video recording device, and configuring the remote data processing system to be capable of retrieving the video files to the remote data processing system.

In another embodiment, the method further comprises configuring the remote data processing system to be capable of disabling the ABM upon confirmation of suspicious activity recorded in the video files.

In another aspect of the invention, there is provided a data processor readable medium storing data processor code that, when loaded into a data processing device, adapts the device to assist in surveillance of a suspect of automated banking machine (ABM) fraud, the data processor readable medium including: code for operatively connecting the data processing device to an ABM, and for receiving an alarm notification upon detection of the presence of a foreign device targeting the ABM; code for operatively connecting the data processing device to a video recording device, and upon receipt of the alarm notification, for retrieving a plurality of recorded video files for a surveillance camera targeting at least one of the ABM and its surroundings.

In an embodiment, the data processor readable medium further includes code for operatively connecting the data processing device to the ABM and to the video recording device over a communications network.

In another embodiment, the data processor readable medium further includes code for configuring the data processing device to enable review of the plurality of recorded video files for suspicious activity.

In yet another embodiment, the data processor readable medium further includes code for configuring the data processing device to disable the ABM upon confirmation of suspicious activity.

These and other aspects of the invention will become apparent from the following more particular descriptions of exemplary embodiments.

BRIEF DESCRIPTION OF THE DRAWINGS

In the figures which illustrate exemplary embodiments of the invention.

DETAILED DESCRIPTION OF THE INVENTION

As noted above, the present invention relates to a method and system for timely surveillance of suspects of ABM fraud.

As will be explained below, the invention may be embodied in methods, and in various hardware configurations which may include data processing systems, networks, devices, software and firmware. The particular configurations shown by way of example in this specification are not meant to be limiting.

Figure 1:
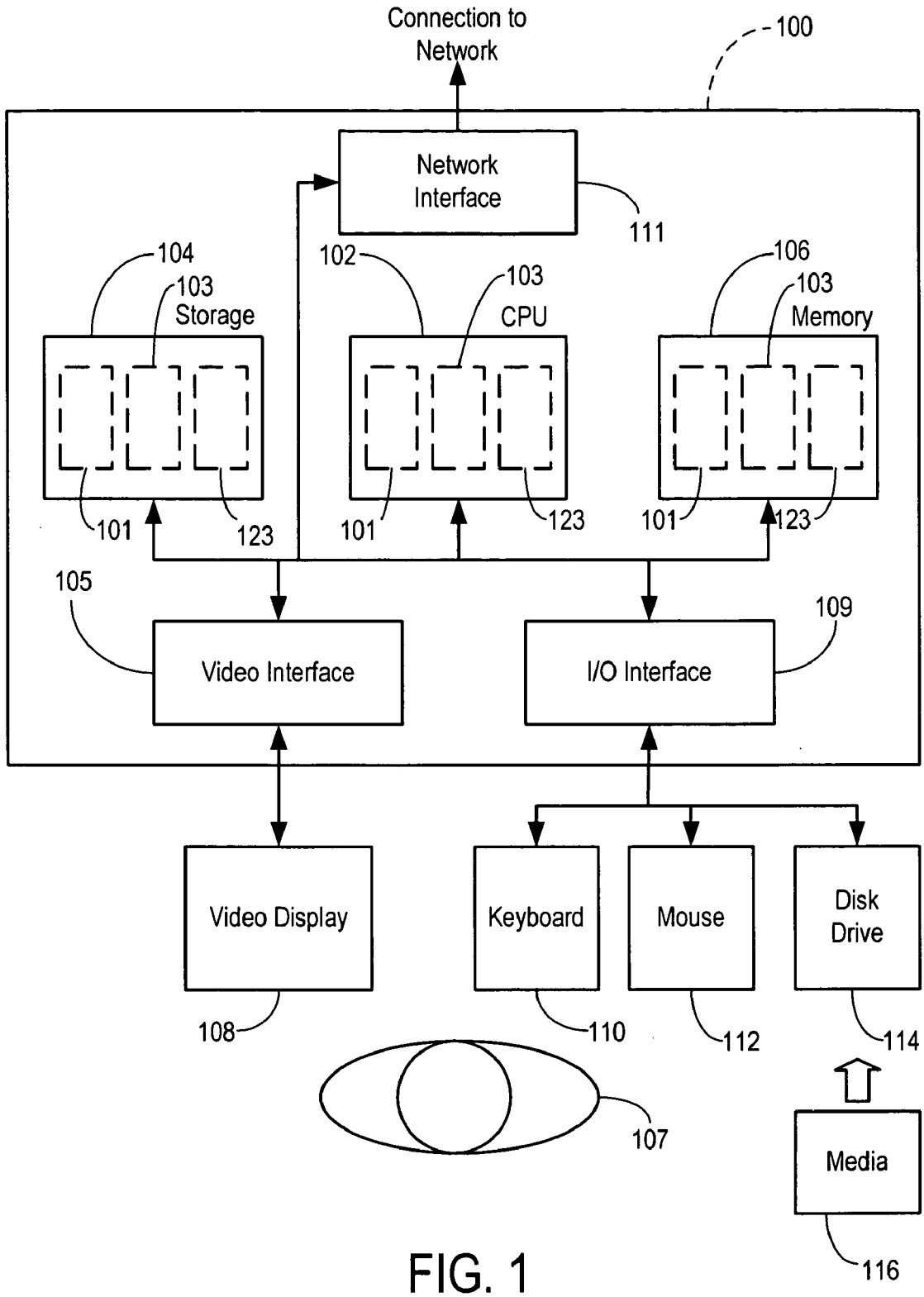
FIG. 1 shows a generic data processing system that may provide a suitable operating environment.

By way of example, FIG. 1 shows a generic data processing system 100 that may include a central processing unit ("CPU") 102 connected to a storage unit 104 and to a random access memory 106. The CPU 102 may process an operating system 101, application program 103, and data 123. The operating system 101, application program 103, and data 123 may be stored in storage unit 104 and loaded into memory 106, as may be required. An operator 107 may interact with the data processing system 100 using a video display 108 connected by a video interface 105, and various input/output devices such as a keyboard 110, mouse 112, and disk drive 114 connected by an I/O interface 109. In a known manner, the mouse 112 may be configured to control movement of a cursor in the video display 108, and to operate various graphical user interface ("GUI") controls appearing in the video display 108 with a mouse button. The disk drive 114 may be configured to accept data processing system readable media 116. The data processing system 100 may form part of a network via a network interface 111, allowing the data processing system 100 to communicate with other suitably configured data processing systems (not shown).

Figure 2A:
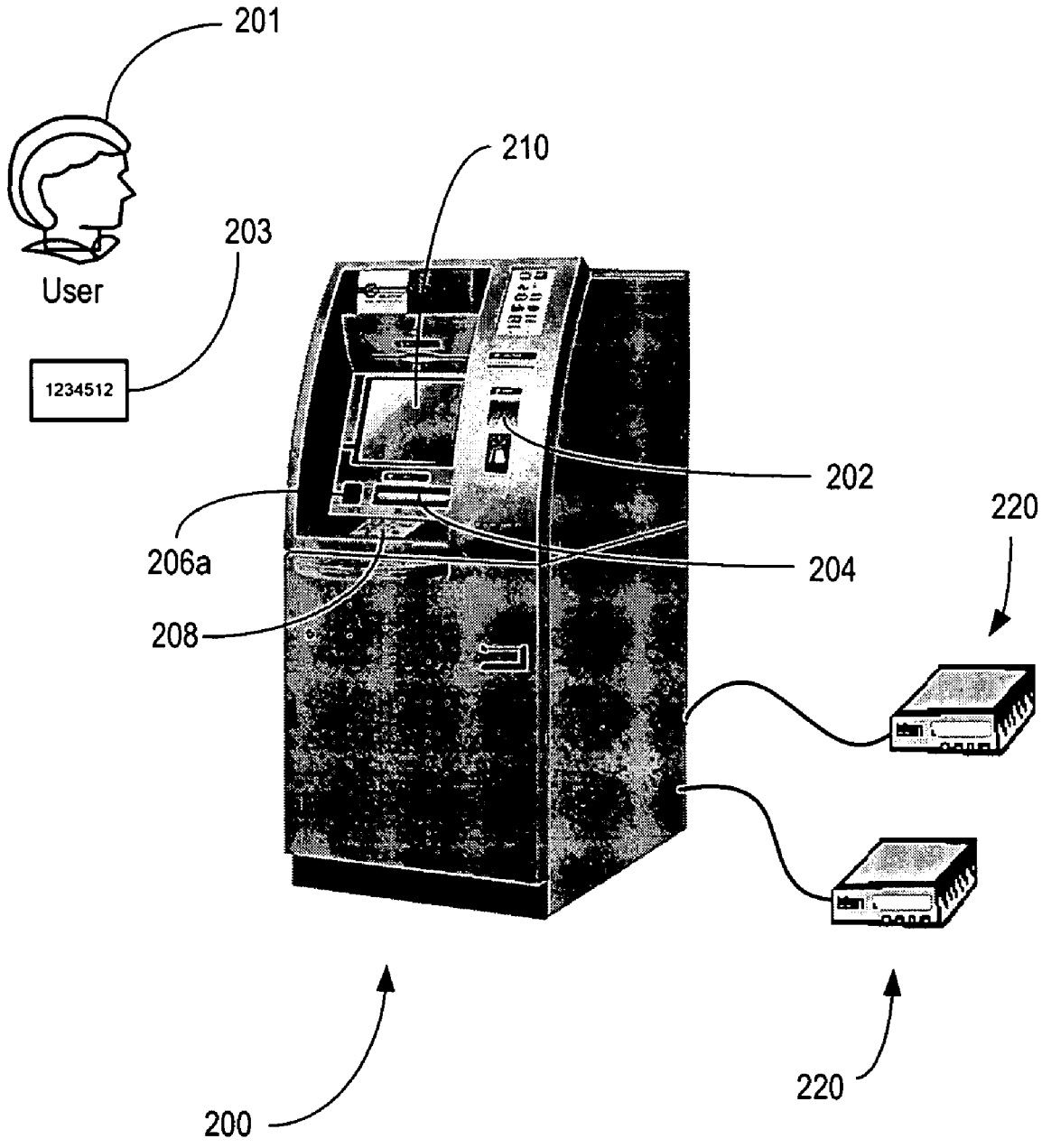
FIG. 2A shows a perspective view of an illustrative ABM.

FIG. 2A shows a perspective view of an illustrative automated banking machine or ABM 200. By way of example, a data processing system (such as data processing system 100 of FIG. 1) may be suitably configured for integration into ABM 200 together with various devices such as a bank card slot 202, a cash dispenser 204, and a surveillance camera 206*a*. A keypad 208 may be provided near display 210 in order to permit ABM user 201 to enter a PIN. Display 210 may be suitably configured to display various prompts and menu options to user 201. User 201 with a bank card 203 may gain access to ABM 200, navigate menu options displayed on display 210, and enter data in response to prompts using keypad 208 and/or other function keys provided near or adjacent display 210.

As shown in FIG. 2A, one or more video recording devices 220 may be operatively connected to ABM 200 to record videos captured by surveillance camera 206*a*. Video recording devices 220 may be physically placed within ABM 200, or placed in another secure location with separate physical access.

Figure 2B:
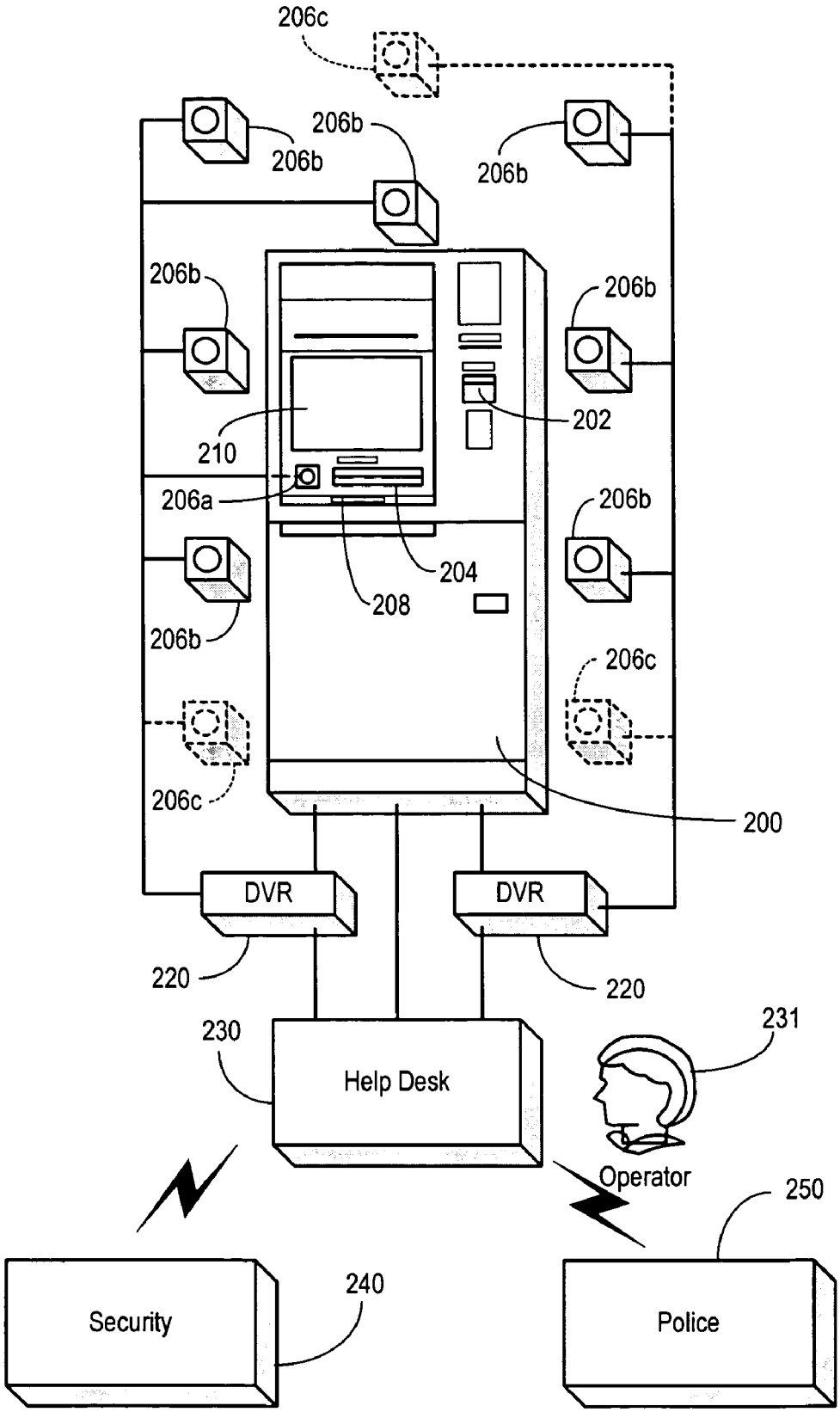
FIG. 2B shows a schematic block diagram of the ABM of FIG. 2A within an illustrative ABM video surveillance system.

FIG. 2B shows a schematic block diagram of the ABM of FIG. 2A within an illustrative video surveillance system. As shown in FIG. 2B, video recording devices 220 may be connected to a plurality of surveillance cameras 206*a*, 206*b*, 206*c*. Each surveillance camera 206*a*, 206*b*, 206*c* may include, for example, a charged coupled device (CCD) sensor for sensing images received through a lens, and circuitry for outputting the images sensed on the CCD to a video recording device 220.

Some surveillance cameras 206*a*, 206*b* may be conspicuously positioned in, on or around ABM 200 to act as a visual deterrent. Other surveillance cameras 206*c* may be discreetly positioned in, on or around ABM 200 so that they are not easy to spot. For example, cameras 206*c* may be miniaturized and camouflaged to avoid easy detection.

The total number of surveillance cameras 206*a*, 206*b* and 206*c* (collectively surveillance cameras 206) and their individual placement in, on or around each ABM 200 may be adapted to account for variations in lines of sight, lighting conditions, and other physical or environmental considerations particular to the location of each ABM 200. Some surveillance cameras 206 may be placed so that they may not readily be blocked even if noticed (e.g. placed out of reach on a high ceiling, etc.). Other surveillance cameras 206 may be targeted to cover secured entry points, such as entry points requiring a user to swipe his or her bank card in order to gain physical access to ABM 200. One or more of surveillance cameras 206 should be able to capture a clear image of a suspect in the act—for example, placing a skimming device such as an unauthorized magnetic stripe reader on ABM 200 or at a secured entrance, or placing a spy camera to view PIN numbers being entered.

Still referring to FIG. 2B, video recording devices 220 may be operatively connected to ABM 200 to record video captured by surveillance camera 206*a*. As well, video recording devices 220 may be connected to the plurality of other surveillance cameras 206*b*, 206*c* that may be placed in, on or around ABM 200 as described above. Video recording devices 220 may be configured in one of any number of different configurations. For example, each video recording device 220 may be connected to some of the surveillance cameras 206. Alternatively, each video recording device 220 may be connected redundantly to all surveillance cameras 206. In this latter case, video signals from each surveillance camera 206 may be split as necessary for input into each video recording device 220. The number of surveillance cameras 206 used may depend on the location and surrounding environment of each ABM 200, and by the input and recording capacity of video recording devices 220.

In an embodiment, each video recording device 220 may be enabled for network communications. By way of example, video recording device 220 may be a network communications capable digital video recorder (DVR). A data processing system (such as data processing system 100 of FIG. 1) may be suitably configured as a network communications capable DVR with appropriate video capture interfaces and a video recording software application to receive and record video images from surveillance cameras 206. The DVR may be configured to be capable of recording video in one of a number of different digital video file formats, at a suitable resolution for positively identifying suspects. However, the resolution should also allow for convenient communication of the recorded video files over a communications network. The DVR may also be an application specific dedicated system. By way of illustration, one of the NETVISION™ DVR models available from Chubb Security of Hartford, Conn. may be used as the DVR. Presently available NETVISION DVR models from Chubb Security may, for example, receive input and simultaneously record video images from eight or sixteen surveillance cameras attached to the DVR.

In the illustrative example in FIG. 2B, a help desk system 230 is connected via a communications network to each video recording device 220. Help desk system 230 may also be operatively connected to ABM 200 by a suitable communications network. By way of example, the communications network may be the Internet, or an available local area network (LAN) or wide area network (WAN) running a common network protocol such as TCP/IP.

Help desk system 230 may be, for example, a suitably configured network enabled data processing system (such as data processing system 100 of FIG. 1) running a help desk software application. An operator 231 of help desk system 230 may retrieve, via the communications network, one or more video files stored on each video recording device 220 for viewing. This may allow the operator 231 to review the video files, and make an assessment as to whether or not the ABM alarm is false.

Still referring to FIG. 2B, help desk system 230 may also be configured to communicate with a security system 240 and/or a police system 250. Each of security system 240 and police system 250 may be, for example, a suitably configured data processing system (e.g. data processing system 100 of FIG. 1) capable of communicating with help desk system 230. Network communications between help desk system 230, security system 240 and police system 250 may be enabled, for example, by the Internet, or other available LAN or WAN networks. Operator 231 may also communicate verbally by telephone with security or police personnel.

Figure 2C:
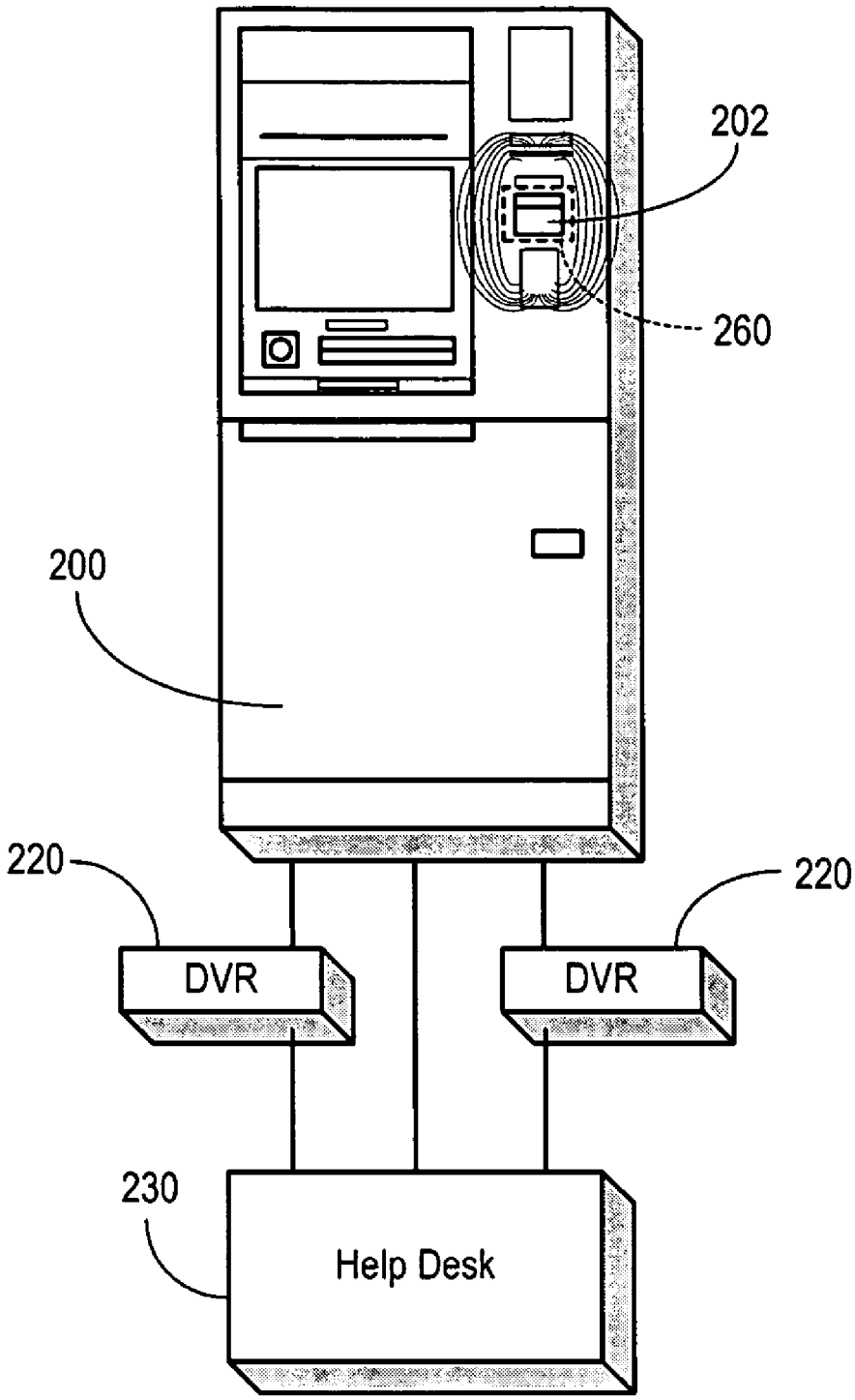
FIG. 2C shows a schematic block diagram of the ABM of FIG. 2A with an illustrative detector for detecting an unauthorized foreign device.

Now referring to FIG. 2C, a schematic block diagram of the ABM of FIG. 2A is shown with an illustrative detector 260 for detecting the presence of an unauthorized foreign device. By way of example, detector 260 may be configured and calibrated to detect a steady state electromagnetic field "signature" generated in the vicinity of bank card slot 202. Detector 260 may then be configured to detect changes in the electromagnetic field when a foreign device with components capable of disturbing the electromagnetic field is placed in the vicinity of bank card slot 202. For example, skimmers capable of reading the magnetic stripe on bank card 203 and placed near bank card slot 202 will normally include circuitry and/or components that will sufficiently disturb the electromagnetic field to be detected by detector 260. By way of example, detector 260 may be an electromagnetic field based skimmer detector manufactured by Wincor Nixdorf of Paderborn, Germany.

In an embodiment, detector 260 may be configured with a sufficiently long delay clock so that temporary disturbances of the electromagnetic field by innocuous devices such as watches and cell phones will not set off a false positive alarm. This delay in triggering the alarm may be set to be several minutes long, for example, so that if the electromagnetic field signature returns to the expected steady state before expiration of the delay, an alarm will not be triggered. In this case, the delay clock would be reset. When the alarm is triggered, it may be a silent alarm so that a lingering suspect is not immediately alerted to the fact that the foreign device has been detected. This may potentially create an opportunity for the suspect to be apprehended by law enforcement authorities while still on the scene, as explained further below.

As another example, another type of detector may be configured to detect an unauthorized foreign object placed on ABM 200 by comparing a baseline image A of ABM 200 with a possibly altered test image B of ABM 200 if a foreign object is attached. This type of detector may periodically take a test image B at preset test intervals (e.g. every minute). The detector may be configured to conduct an automated A/B image comparison at each test interval to detect any foreign object placed on ABM 200. A number of successive A/B comparisons (e.g. three successive comparisons) may be conducted by the detector to confirm that a foreign object has not been placed on the ABM just briefly. Upon detection of a suspect foreign object, an alarm may be triggered as before.

For further enhanced security, other suitable detectors and surveillance systems may also be used, such as an audio surveillance device to listen for suspicious activity generated by attempts to gain access to ABM 200. Also, radiofrequency listening devices may be configured to listen for suspicious radiofrequency signals being transmitted from the vicinity of ABM 200 to a nearby receiver being operated by a suspect. It will be appreciated that more than one detection system may be used at the same time. It will also be appreciated that a detector may be used at other strategic locations in the vicinity of ABM 200, such as at a bank card reader positioned at a secured entrance to gain access to ABM 200.

Now referring to FIG. 3, an illustrative method by which an ABM alarm may be handled will now be described in more detail. In an embodiment, the method shown in FIG. 3 may be embodied in data processor code that, when loaded into a data processing device, adapts the device to follow the steps specified by method 400.

Figure 3:
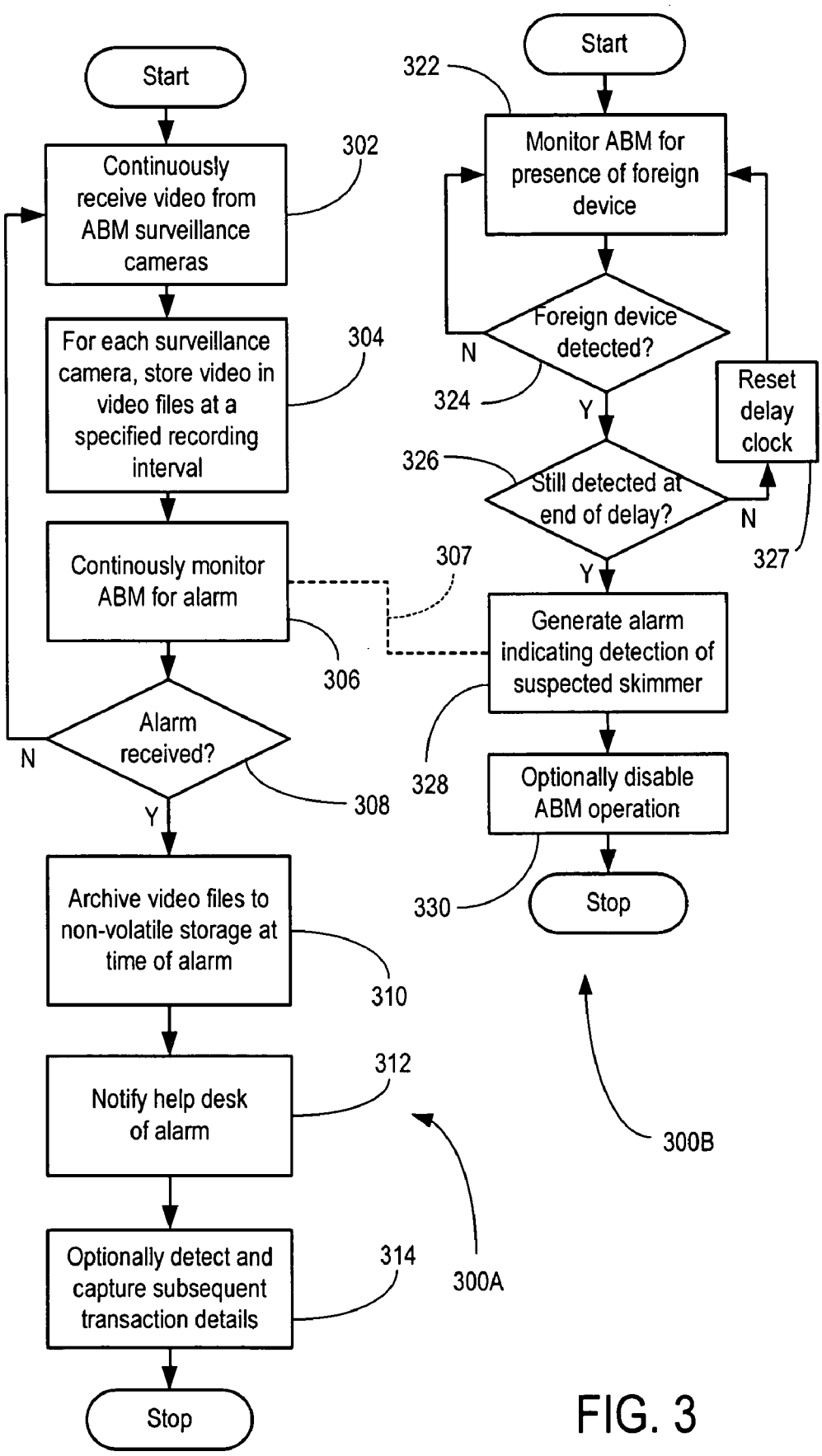
FIG. 3 shows a flow chart of an illustrative method for surveillance of suspects of ABM fraud in accordance with an embodiment.

As shown in FIG. 3, the method may include sub-methods 300A and 300B. Sub-method 300A begins at block 302, where a plurality of surveillance cameras (e.g. surveillance cameras 206 of FIG. 2B) may be used to continuously monitor target ABM 200 and its immediate surroundings, and provide multiple video signals for recording using one or more video recording devices (e.g. video recording devices 220 of FIG. 2B).

From block 302, sub-method 300A proceeds to block 304 where, for each surveillance camera 206, the video signals may be recorded in video recording devices 220. The video signals from surveillance cameras 206 may be processed through an analog-to-digital (A/D) converter if necessary, and recorded in a digital format. In an embodiment, the video signal from each surveillance camera N may be recorded digitally in corresponding video files $X_N$, $Y_N$. Video recording devices 220 may be configured to record the video signal from surveillance camera N in video files $X_N$, $Y_N$ as they are alternated or rotated in succession, such that after an initial start-up period at least one of video files $X_N$, $Y_N$ has a recorded length of video from surveillance camera N exceeding the predetermined delay for alarm notification. For example, if the predetermined delay is set at three minutes, in order to accommodate videos from all of the surveillance cameras 206, the maximum recorded length of each video file $X_N$, $Y_N$ may be preset to a relatively short duration of five or ten minutes each.

By way of example, video files $X_N$, $Y_N$ may be rotated in succession as follows: Video recording device 220 may start by recording a video signal from surveillance camera N in video file $X_N$. Upon reaching the preset recording limit for video file $X_N$, the video recording device 220 may close video file $X_N$ and automatically switch to recording the video signal from surveillance camera N in video file $Y_N$ (overwriting any previously recorded version of video file $Y_N$). Upon reaching the preset recording limit for video file $Y_N$, the video recording device 220 may close video file $Y_N$ and automatically switch back to recording video in video file $X_N$ (overwriting any previously recorded version of video file $X_N$), and so on. In this manner, at any given point in time after an initial start-up period for video recording device 220, there will be at least one video file ($X_N$ or $Y_N$) with, say, ten minutes of recorded video for surveillance camera N. The other file ($Y_N$ or $X_N$) may have anywhere between zero and ten minutes of recorded video, depending on the point in the alternating recording cycle. Between video files $X_N$ and $Y_N$, there should be a sufficient length of video recorded from a particular surveillance camera N for use in identifying a suspect. It will be appreciated that more than two video files may be used for the successive rotation if desired, although the total length of video to be reviewed should be reasonable for timely surveillance and assessment.

From block 304, sub-method 300A may proceed to block 306, where sub-method 300A may continuously monitor ABM 200 for an alarm condition. By way of example, the alarm condition may be communicated in the form of an unsolicited status message generated by ABM 200 when detector 260 (FIG. 2C) detects the presence of a foreign device after the specified delay period. The alarm condition may have a time stamp, indicating the time that the foreign device was first detected by detector 260, and/or the time that the alarm condition was activated.

Sub-method 300A may then proceed to decision block 308 where, if an alarm condition (e.g. unsolicited status message) is received, sub-method 300A proceeds to block 310 where all video files $X_N$, $Y_N$ for all N surveillance cameras 206 are archived. Setting the recording limit for each video file $X_N$, $Y_N$ to be longer than the preset delay in triggering the alarm should ensure that a video of a sufficient length of time is recorded in at least one of video files $X_N$, $Y_N$. By way of example, if detector 260 of FIG. 2C is used, and the preset delay period for triggering an ABM alarm is set at three minutes, then there should be at least seven minutes and possibly up to seventeen minutes of video collectively recorded in video files $X_N$, $Y_N$, prior to when detector 260 first detected the presence of a foreign device, subsequently triggering the alarm. With placement of a plurality of surveillance cameras 206 in various locations in, on and around ABM 200 as previously described, the possibility that an image suitable for identification of the suspect is recorded in one of video files $X_N$, $Y_N$ may be increased.

From block 310, sub-method 300A may proceed to block 312, where sub-method 300A may notify a help desk system operator (e.g. operator 231 stationed at help desk 230 of FIG. 2B) that an ABM alarm has been triggered. Optionally, sub-method 300A may record and capture subsequent transaction details occurring at the ABM 200. If the suspect is not apprehended, then this transaction log could be used to identify bank card holders whose bank card data may have been compromised.

Still referring to FIG. 3, sub-method 300B starts at block 322 to periodically or continuously monitor an ABM 200 for the presence of a foreign device, such as a bank card skimmer. At decision block 324, if a foreign object is detected, sub-method 300B may start a delay clock to measure out a preset delay and then proceed to decision block 326. Otherwise, if the foreign device is removed before the end of the delay, sub-method 300B may proceed to block 327 to reset the delay clock, then loop back to block 322 and continue.

At decision block 326, if the preset delay has been reached without the clock being reset (e.g. detector 260 has not detected a return to steady state by the end of the delay period), then sub-method 300B may proceed to block 328, where an ABM alarm is triggered. As previously described, this alarm may be detected by sub-method 300A at block 306. If the preset delay is not reached, then sub-method 300B may loop back to block 322 and continue.

If an alarm is generated or triggered at block 328, sub-method 300B may optionally disable further operation of ABM 200, so that any loss at that ABM 200 is limited. In an embodiment, any potentially compromised bank cards that were used at the disabled ABM 200 within a certain time period prior to disabling of ABM 200 may be flagged for surveillance and notification of affected users. Alternatively, where the potentially compromised bank cards are issued by the financial institution operating ABM 200, the bank card may be cancelled immediately to prevent subsequent fraudulent use. Subsequent attempts at use of the cancelled bank card may, for example, advise the user to contact the financial institution for further information. In an embodiment, rather than being automatic, the decision to cancel a potentially compromised bank card may be left to a human operator (e.g. an operator at a help desk or security desk, or a person notified at an affected financial institution), as discussed below.

Figure 4:
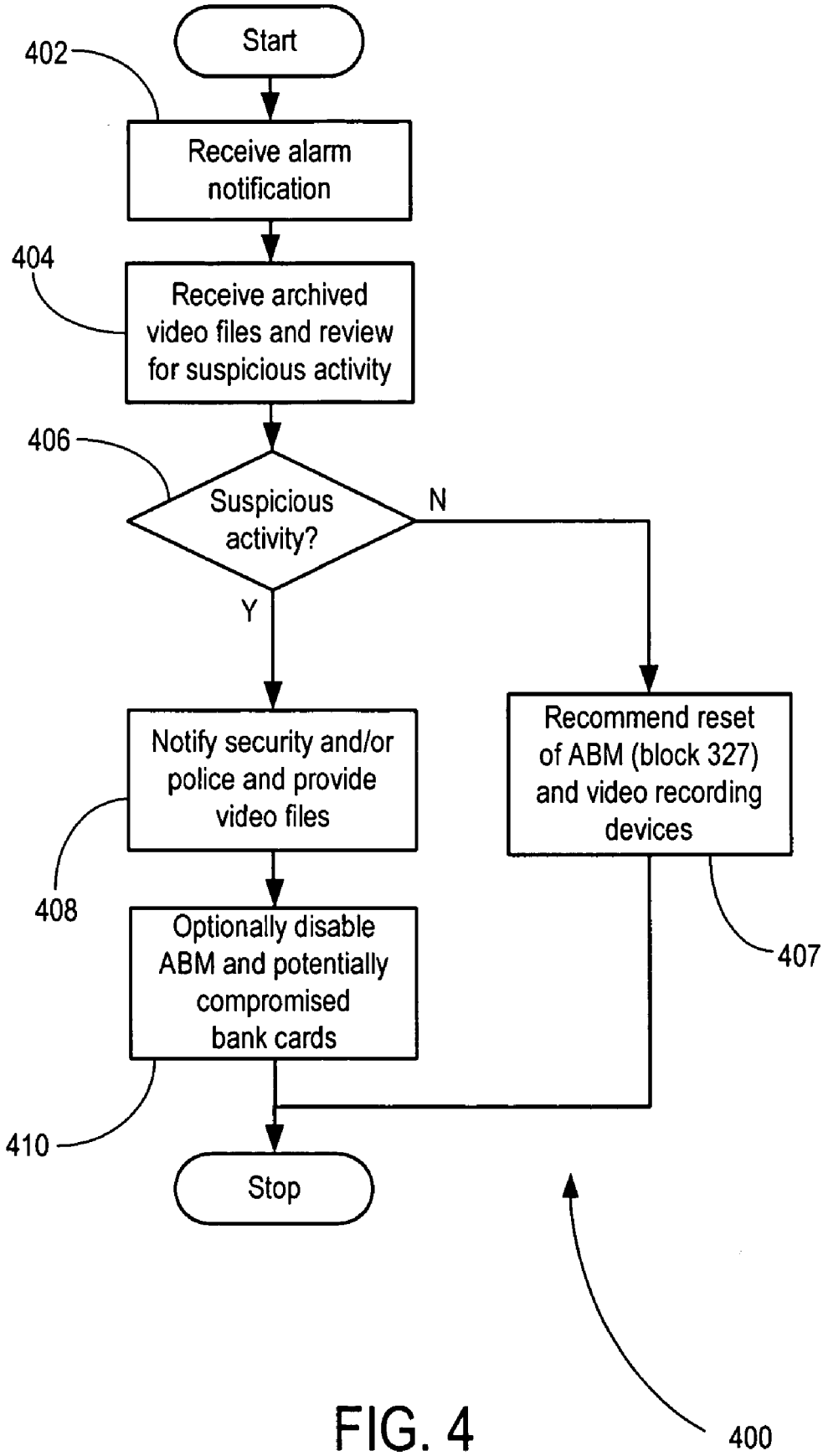
FIG. 4 shows a flow chart of an illustrative method for verifying potential ABM fraud and for notifying appropriate authorities.

Now referring to FIG. 4, there is shown a flow chart of an illustrative method 400 for assessing potential ABM fraud and for notifying authorities if appropriate. In an embodiment, method 400 may be embodied in data processor code that, when loaded into a data processing device, adapts the device to prompt a help desk operator 231 to follow the steps specified by method 400.

As previously described, a help desk system 230 may be manned by a help desk operator 231 to monitor ABM 200 and to deal with alarm conditions that may originate from the monitored ABM 200. As shown, method 400 may begin at block 402, where an alarm notification may be received from ABM 200 (i.e. from block 312 of FIG. 3). Upon receipt of the alarm notification at block 402, method 400 may proceed to block 404 where video files $X_N$, $Y_N$—previously archived upon triggering of the alarm and stored in video recording devices 220—are uploaded to help desk system 230 for review. Operator 231 may then be prompted to review video files $X_N$, $Y_N$ for suspicious activity, especially around and just before the time period that the foreign device was first detected (i.e., as determined by the time stamp communicated together with the alarm notification and subtracting the known delay period). For this purpose, multiple views of ABM 200 recorded from different surveillance cameras 206 may be reviewed by operator 231 simultaneously, and at a suitable fast-rewind or fast-forward speed. Method 400 may then proceed to decision block 406 where, if operator 231 confirms suspicious activity, operator 231 may be prompted to proceed to block 408 and to report the matter to security or police, together with a copy of the complete video files $X_N$, $Y_N$ or representative subsets (i.e. single frame captures).

In an embodiment, method 400 may proceed to block 410, where operator 231 may be prompted to make a decision whether or not to disable ABM 200. As well, operator 231 may be prompted to determine whether or not to cancel, if possible, potentially compromised bank cards that have been used at ABM 200 for a period of time from the detection of the foreign device to the alarm being sent. If compromised bank cards belong to another financial institution, the operator may be prompted to contact that financial institution to inform them of the potential exposure.

In an embodiment, in addition to receiving archived video files $X_N$, $Y_N$, operator 231 may also receive real-time input from one or more surveillance cameras 206 to determine if the suspect is still lingering in the area. If so, operator 231 may determine that ABM 200 should remain operational so that the suspect is not alerted to the detection, and immediately alert appropriate authorities such as security or police so that there is an opportunity to apprehend the suspect at ABM 200 or its surroundings.

Alternatively, as described earlier, ABM 200 may be disabled automatically upon triggering of an alarm, and investigation of the potential security breach by security or police may have to be completed before ABM 200 can be reset.

In another embodiment, the alarm notification may bypass help desk 230 and be communicated automatically by ABM 200 to security system 240, or to police system 250. In this case, security system 240 or police system 250 may retrieve video files $X_N$, $Y_N$ directly from video recording devices 220, and security or police may review video files $X_N$, $Y_N$ for suspicious activity. As will be appreciated, video files $X_N$, $Y_N$ may be very helpful to a timely investigation, and may subsequently be used as evidence for trial if the suspect is apprehended.

While various illustrative embodiments of the invention have been described above, it will be appreciated by those skilled in the art that variations and modifications may be made. Thus, the scope of the invention is defined by the following claims.

What is claimed is:

1. A system for surveillance of a suspect of automated banking machine (ABM) fraud, comprising:

at least one detector for detecting the presence of a foreign device targeting an ABM, the at least one detector being configured to generate an alarm notification upon such detection after a predetermined delay;

at least one surveillance camera, each surveillance camera targeting at least one of the ABM and its surroundings;

a video recording device for recording at least one video signal from the at least one surveillance camera, the video recording device being configured to archive the at least one video signal recorded from at least one surveillance camera upon receipt of the alarm notification;

wherein the at least one archived recorded video signal has a recording length exceeding the predetermined delay.

2. The system of claim 1, wherein the at least one detector an electromagnetic field based detector, and the predetermined delay is longer than temporary disturbances in the electromagnetic field caused by routine use of the automatic banking machine by users.

3. The system of claim 1, wherein;

the video recording device records the at least one video signal as digital data formatted in the form of a plurality of video files, with the plurality of video files being recorded and repeatedly overwritten in sequence during operation of the system prior to the receipt of any alarm notification; and the video recording device is configured to archive the at least one video signal recorded from the at least one surveillance camera upon receipt of the alarm notification by storing the plurality of video files in a manner such that the plurality of video files will not be overwritten by operation of the system.

4. The system of claim 3, wherein each of the corresponding video files of the plurality of video files is preset to have a maximum recording length exceeding the predetermined delay for alarm notification.

5. The system of claim 4, wherein:

the plurality of video files consists of two video files; and the two video files have equal recording lengths.

6. The system of claim 3, further including a remote data processing system operatively connected to the ABM and to the video recording device, the remote data processing system being configured to retrieve the plurality of video files archived by the video recording device.

7. The system of claim 6, wherein the remote data processing system is operatively connected to the ABM and to the video recording device over a communications network.

8. The system of claim 6, wherein the remote data processing system is adapted to disable the ABM upon confirmation of suspicious activity recorded in the retrieved video files.

9. The system of claim 1, wherein the at least one detector is one of an electromagnetic field sensing device, an image comparison device, and a radiofrequency sensing device.

10. A method of surveillance of a suspect of automated banking machine (ABM) fraud, comprising:

recording at least one video signal from at least one surveillance camera, each surveillance camera targeting at least one of the ABM and its surroundings;

detecting the presence of a foreign device targeting the ABM and, upon such detection, generating an alarm notification after a predetermined delay;

upon receipt of the alarm notification, archiving the at least one video signal recorded from the at least one surveillance camera so the at least one archived recorded video signal has a recording length exceeding the predetermined delay.

11. The method of claim 10, the detecting step is performed by an electromagnetic field based detector, and the predetermined delay is longer than temporary disturbances in the electromagnetic field caused by routine use of the automatic banking machine by users.

12. The method of claim 10, wherein:

at the recording step, the at least one video signal is recorded as digital data formatted in the form of a plurality of video files, with the plurality of video files being recorded and repeatedly overwritten in sequence during operation of the system prior to the receipt of any alarm notification; and at the archiving step, the at least one video signal is archived by storing the plurality of video files in a manner such that the plurality of video files will not be overwritten by operation of the system.

13. The method of claim 12, further comprising setting a maximum recording length for each of the corresponding video files of the plurality of video files to exceed the predetermined delay for alarm notification.

14. The method of claim 13, wherein:

the plurality of video files consists of two video files; and at the setting step, the two video files are set to have equal recording lengths.

15. The method of claim 12, further comprising providing a remote data processing system operatively connected to the ABM and to the video recording device, and configuring the remote data processing system to be capable of retrieving the plurality of archived video files to the remote data processing system.

16. The method of claim 15, further comprising configuring the remote data processing system to disable the ABM upon confirmation of suspicious activity recorded in the retrieved video files.

17. A data processor readable medium storing data processor code that, when loaded into a data processing device, adapts the device to assist in surveillance of a suspect of automated banking machine (ABM) fraud, the data processor readable medium including:

code for operatively connecting the data processing device to a detector adapted to detect of the presence of a foreign device targeting the ABM and to a video recording device adapted to record a plurality of video files of video images showing at least a portion of the vicinity of the ABM;

code for generating an alarm notification upon detection of the presence of a foreign device targeting the ABM that persists for at least a predetermined delay period;

code for archiving the plurality of recorded video files to non-volatile storage upon receipt of an alarm notification.

18. The data processor readable medium of claim 17, further including:

code for generating a delay clock to measure the predetermined delay; and code for starting the delay clock upon the detection of the presence of a foreign device targeting the ABM;

code for determining whether the presence of a foreign device targeting the ABM is still detected at the end of the predetermined delay as measured by the delay clock; and code for generating an alarm notification when the code for determining has determined that the foreign device targeting the ABM is still detected at the end of the predetermined delay.

19. The data processor readable medium of claim 17, wherein each video file of the plurality of archived video files has a recording length exceeding the predetermined delay.

20. The data processor readable medium of claim 19, wherein the plurality of archived video files consists of two video files.

* * * * *